United States Patent [19]

Gergoe et al.

[11] Patent Number: 4,470,626

[45] Date of Patent: Sep. 11, 1984

[54] CLOSURE LATCH HAVING AN ISOLATED STRIKER

[75] Inventors: Bela Gergoe, Birmingham; Melvin E. Dick, Fenton, both of Mich.

[73] Assignee: General Motors Corporation, Detroit, Mich.

[21] Appl. No.: 435,915

[22] Filed: Oct. 22, 1982

[51] Int. Cl.[3] ..... E05C 13/00

[52] U.S. Cl. ..... 292/341.12; 292/DIG. 53; 292/DIG. 56; 292/DIG. 43

[58] Field of Search ..... 292/341.12, 341.13, 292/DIG. 40, DIG. 43, DIG. 56, DIG. 53

[56] References Cited

U.S. PATENT DOCUMENTS 2,217,892 10/1940 Dodge ..... 292/341.12

2,629,622 2/1953 Roethel ..... 292/341.12

4,157,844 6/1979 Sarosy et al. ..... 292/DIG. 43 X

*Primary Examiner*—Richard E. Moore

*Attorney, Agent, or Firm*—William A. Schuetz

[57] ABSTRACT

An isolated striker assembly for use with a closure means or hatchback, preferably a substantially glass hatchback, of an automotive vehicle is disclosed. The striker assembly includes an elastomeric means having a plurality of compressible projections thereon which serve to dampen vibrations emanating from the vehicle during certain driving conditions so as to reduce vibrations being imparted to the hatchback, which in turn reduces the noise level due to vibrations caused by flexing movement of the hatchback to and from its normal plane during these driving conditions.

3 Claims, 7 Drawing Figures

CLOSURE LATCH HAVING AN ISOLATED STRIKER

The present invention relates to a striker assembly for an automotive vehicle closure latch, and in particular to a striker assembly having an isolated or dampened striker for use with a substantially glass hatchback or closure means of an automotive vehicle.

Known closure latches for hatchbacks of automotive vehicles have included striker assemblies and latch mechanisms respectively carried by the hatchback and adjacent vehicle body structure to be closed or vice versa. Examples of such known latches are shown in U.S. Pat. Nos. 3,321,226 and 4,054,309, assigned to the same assignee as the present invention. In these latches, the striker assemblies have included a U-shaped striker mounted or secured to a metal support plate which in turn was rigidly secured to a metal panel of the hatchback or to the adjacent metal body structure of the vehicle.

On certain current models of vehicles being manufactured by the assignee of the present invention, the hatchback is of a longitudinally elongated, contoured frameless glass design. That is, the hatchback is substantially all glass, and its top and sides are not supported by any metal frame. The hatchback is pivotally supported adjacent its upper edge by a hinge means carried by the vehicle and connected directly to the glass. Only its lower side or rear is supported in or secured to a transversely extending metal frame. This type of hatchback has aesthetic advantages in that it provides for a sleek contoured look.

It has been found that under certain driving conditions, such a frameless hatchback can generate vibrations due to its being flexed slightly in directions transverse from its normal plane. These vibrations tend to or slightly increase the noise or decibel level in the vehicle over that previously encountered with the use of reinforced metallic hatchbacks in similar type vehicles under such driving conditions.

In order to reduce the above-noted noise level, the present invention contemplates providing a striker assembly on the frameless hatchback which is isolated from direct rigid contact with the hatchback. This isolation of the striker is achieved by employing a novel elastomeric compressible dampener between the striker and the support panel which is rigidly secured to the hatchback at its lower or rear end. The novel elastomeric dampener is molded to a configuration such that it dampens the vibrations and thus, suppresses the noise or decibel level caused by the vibrations of the hatchback. This provides for a quieter vehicle ride.

Accordingly, a broad object of the present invention is to provide a new and improved striker assembly for a vehicle closure means, preferably a substantially frameless glass hatchback, which may be slightly flexed to and from its normal plane during certain driving conditions to cause vibratory noise, and in which the striker assembly has a metal striker which is isolated from direct contact with the closure means by a novel elastomeric dampener in order to reduce or suppress such vibratory noise during such driving conditions.

Another object of the present invention is to provide a new and improved striker assembly, as defined in the preceding object, and wherein the striker assembly comprises a striker which is secured to a metal plate, and wherein the elastomeric dampener surrounds the metal plate and includes a plurality of integral spaced projections extending transversely of its sides which are slightly compressed when the striker assembly is attached to the hatchback so that the elastomeric dampener serves to dampen the vibrations generated as a result of the hatchback being flexed to and from its normal plane during certain driving conditions and thus provide for a more quieter vehicle ride.

The present invention further resides in various novel constructions and arrangement of parts, and further objects, novel characteristics and advantages of the present invention will be apparent to those skilled in the art to which it relates and from the following detailed description of the illustrated, preferred embodiment thereof made with reference to the accompanying drawings forming a part of this specification and in which similar reference numerals are employed to designate corresponding parts throughout the several views, and in which.

Figure 1:
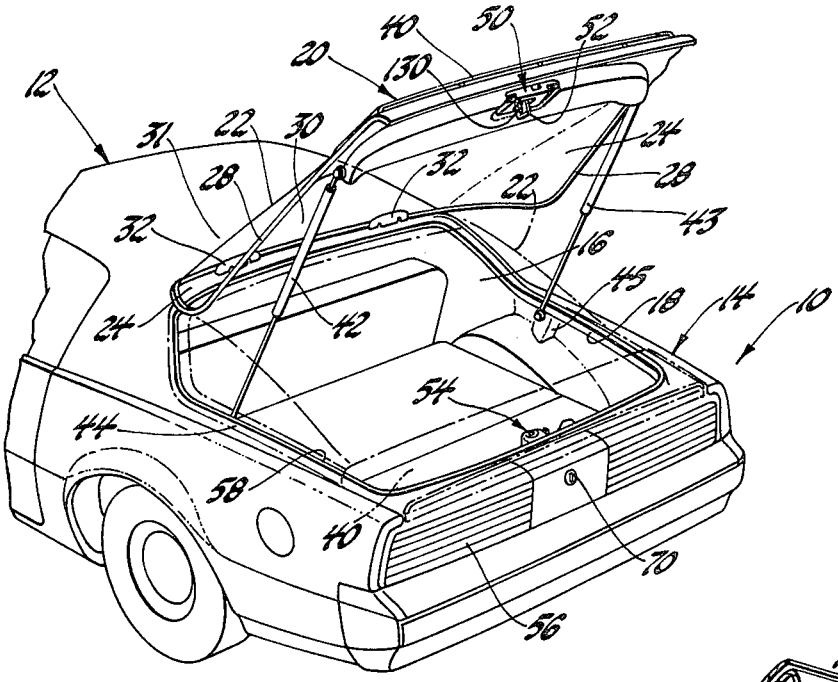
FIG. 1 is a partial perspective view of an automotive vehicle having a frameless glass hatchback incorporating the novel striker assembly of the present invention and in which the hatchback is shown in its open position.
Figure 2:
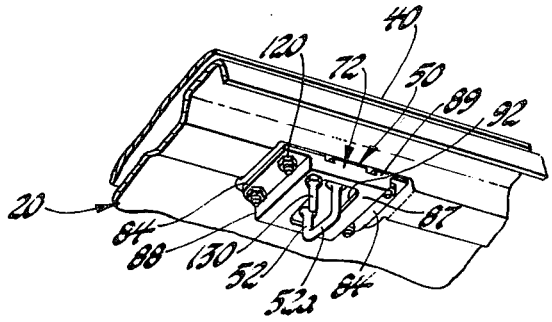
FIG. 2 is an enlarged partial elevational view showing the novel striker assembly of the present invention attached to the hatchback.

Referring to FIG. 1 of the drawings, a partial perspective view of a rear portion 10 of an automotive vehicle 12 is thereshown. The rear portion 10 of the vehicle 12 includes vehicle body structure 14 which defines a rear stowage compartment or trunk 16. The vehicle body structure 14 of the rear portion 10 has a top opening 18 to permit access to the stowage compartment 16 from the rear of the vehicle 12.

The vehicle 12 also includes a rear closure means of hatchback 20 which is movable between an open position, as shown by the solid lines in FIG. 1, in which it permits access to the stowage compartment 16 through the opening 18 and a closed position, as shown by the phantom lines in FIG. 1, in which it closes the opening 18 and covers the stowage compartment 16. The hatchback 20 is made from a substantially frameless, all glass material and includes an elongated glass panel 22 having contoured or curved sides 24. The glass panel 22 along its top and side edges is either painted or contained in a lightweight plastic molding, as indicated by reference numeral 28. The glass panel 22 adjacent its upper end 30 is pivotally connected to the vehicle body structure 14 adjacent its roof structure 31 by suitable or conventional hinge means 32 carried by the roof structure 31. The hinge means 32 are directly connected to the glass panel 22. The glass panel 22 along its lower or rear end is suitably secured to a metal panel assembly 40. The metal panel assembly 40 extends across the width of the glass panel 22 adjacent its rear end.

The hatchback 20 is adapted to be held in its open position, as shown in the solid lines in FIG. 1, when moved thereto by a pair of gas springs 42 and 43. The gas springs 42 and 43 can be of any suitable or conventional construction and are here shown as having one end pivotally connected to an adjacently located side of the metal panel assembly 40 and its other end pivotally connected to sides 44 and 45 of the vehicle body structure 14. The hatchback 20 can be moved from its open position in opposition to the biasing force gas springs 42 and 43 to its closed position, as shown in the phantom lines in FIG. 1, by manually pushing down on the same.

In accordance with the provisions of the present invention, a novel striker assembly 50 is provided which is carried by the hatchback 20. The striker assembly 50 includes a striker 52 which is cooperably engageable by a latch mechanism 54 carried by the vehicle body structure 14 at its rear 56 and located immediately inside the stowage compartment 16. The latch mechanism 54 engages the striker 52 to latch the hatchback 20 in its closed position. A suitable seal strip 58 carried by the vehicle body structure 14 and extending around the periphery of the opening 18 is engaged by the hatchback 20 when in its closed position to seal the stowage compartment from the exterior of the vehicle.

It has been found that the use of a hatchback which is unframed along its top and sides and which is made from substantially all glass material is more flexible than a conventional metal reinforced hatchback assembly. While the use of a substantially all glass hatchback provides for a sleek, aesthetic appearance, its increased flexibility can increase the noise level within the vehicle under certain driving conditions. That is, under certain driving conditions, vibrations imparted to the vehicle can cause the glass hatchback 20 to flex transversely to and from its normal plane when closed, as shown by the phantom lines in FIG. 1, which in turn causes vibratory noise or boom within the vehicle and with the noise level increasing as the resonant frequency of the hatchback is being approached.

In order to reduce this noise level during such driving conditions, the striker assembly 50 of the present invention is constructed in a novel and unique manner so as to dampen the vibrations transmitted to the substantially glass hatchback 20 so as to reduce the noise level to acceptable or normal levels to provide for a quieter ride.

Figure 3:
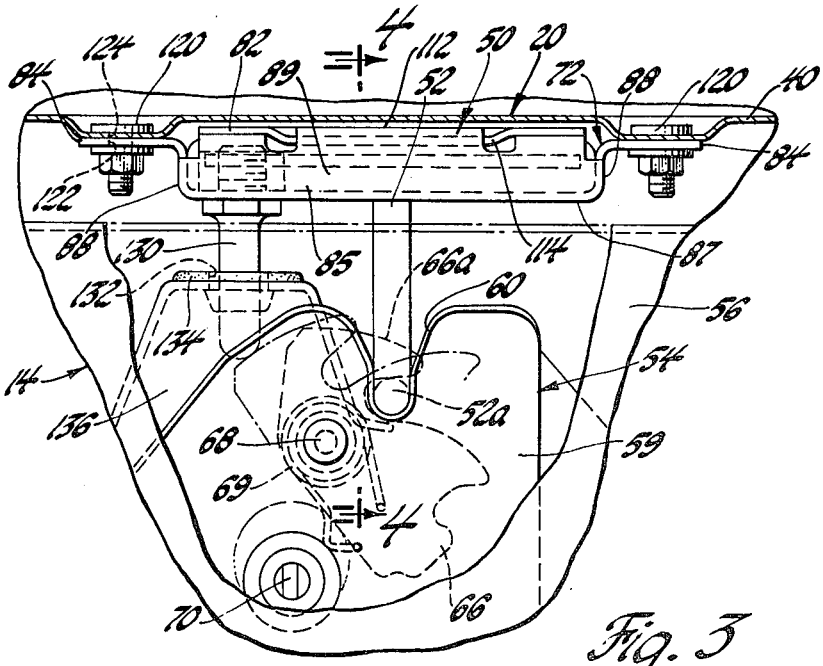
FIG. 3 is an enlarged partial elevational view, with portions broken away, of the rear of the vehicle and showing the hatchback and striker assembly in their latched position on the vehicle.

As best shown in FIGS. 2 through 7, the striker 52 comprises a steel rod which is bent to a U-shaped configuration and with its bite portion 52*a* being horizontally disposed when the hatchback 20 is in its closed position. The striker 52 is adapted to be engaged to hold the hatchback 20 in its closed position, as shown by the phantom lines in FIG. 1, by the latch mechanism 54. The latch mechanism 54 does not per se form a part of the present invention and could be of any suitable or conventional construction such as shown in U.S. Pat. Nos. 4,045,064 or 4,054,309. Suffice it to say that the latch mechanism 54 includes a retainer member 59 carried by the vehicle body structure 14 at its rear 56. The retainer member 59 is made from stamped sheet steel and has a tapered entry slot 60. When the striker 52 is lowered it is received within the tapered slot 60, as shown in FIG. 3. When in this position the hatchback 20 engages the seal 58. The striker 52 is adapted to be held in its closed position by a pivotal latch member 66 having a hook shaped end 66*a*. The latch member 66 is pivotally supported by a pivot pin means 68 secured to the retainer member 59 and is biased toward a first position, as shown by the dotted lines in FIG. 3, in which its hooked end 66*a* overlies the striker 52 to retain the same in a latched position by a coil spring means 69. The spring 69 surrounds the pivot pin 68 and has one end secured to the stationary retainer member 59 and its other end in engagement with the latch member 66. When the striker 52 enters the tapered slot 60 it engages the hooked end 66*a* of the latch member 66 and cams the same in a counterclockwise direction about its pivotal axis and in opposition to the biasing force of the coil spring 69 to the position shown by the phantom lines in FIG. 3. When the bite portion 52*a* of the striker 52 clears the hook portion 66*a*, the spring 69 will cause the latch member 66 to pivot in a clockwise direction so that the hook end 66*a* overlies the bite portion 52*a* of the striker 52.

To release the hatchback 20 for movement from its closed position to its open position, a suitable key operated cam arrangement 70 is provided to engage and move the latch member 66 in a counterclockwise direction to release the hooked shaped end 66*a* from the bite portion 52*a* of the striker 52. When this occurs, the gas springs 42 and 43 will pop open the hatchback 20.

The novel striker assembly 50 comprises, in general, a support and retainer plate or housing 72, a support plate 74 disposed within the housing 72, and secured to the U-shaped striker 52 at its free ends 52*b* and 52*c*, an elastomeric dampener 80 molded to the support plate 74 and surrounding its peripheral edges and a cover plate 82 for compressing the elastomeric dampener 80 and which is held in place by the housing 72.

Figure 4:
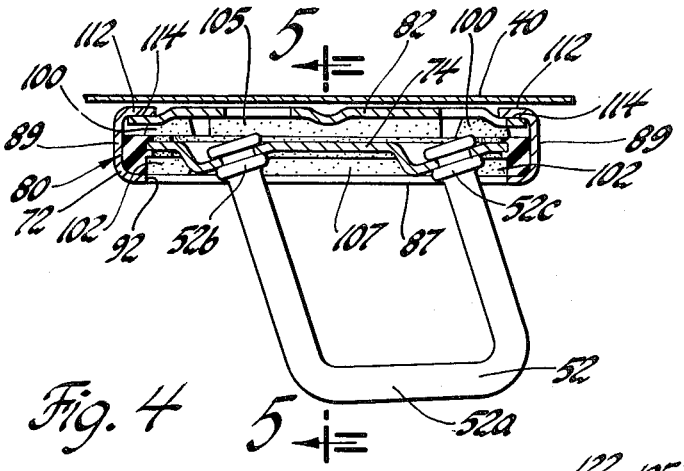
FIG. 4 is a sectional view with parts shown in elevation and taken along the direction of the arrows 4—4 of FIG. 3.
Figure 5:
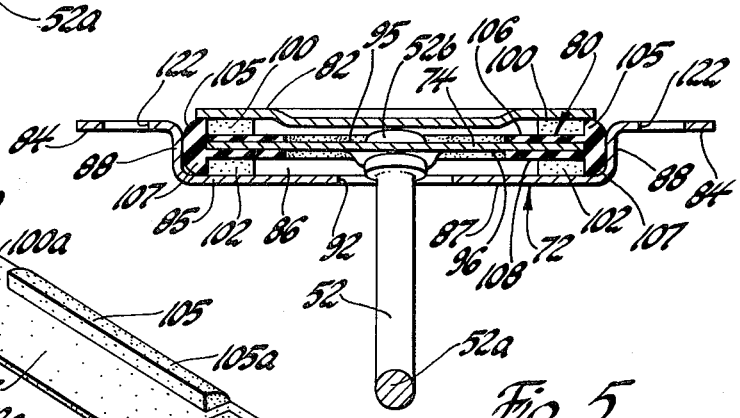
FIG. 5 is a sectional view taken along the direction of the arrows 5—5 of FIG. 4.

As best shown in FIGS. 4 and 5, the support and retainer housing 72 comprises a one-piece, stamped metallic member having a pair of oppositely extending end flanges 84 and a U-shaped intermediate portion 85, as viewed in cross-section, which defines a well or recess 86. The U-shaped portion 85 is of a generally square or rectangular shape and is defined by a flat bottom 87, pair of end walls 88 integral with the flanges 84 and a pair of side walls 89 integral with the bottom 87 and located between the flanges 84. The bottom 87 of the U-shaped portion has a central through opening 92. The walls 88 and 89 and the bottom 87 define the generally rectangularly shaped recess 86.

Disposed within the recess 86 of the U-shaped portion 85 of the support and retainer housing 72 is the support plate 74. The support plate 74 is generally square shaped, made from a metal stamping and stamped to the configurations shown in FIGS. 4 and 5. The striker 52 at its free ends 52*b* and 52*c* is suitably secured to the support plate 74 by upset staking the free ends 52*b* and 52*c* to the support plate 74. The striker 52 extends through the opening 92 in the bottom 87 of the support and retainer housing 72.

Figure 6:
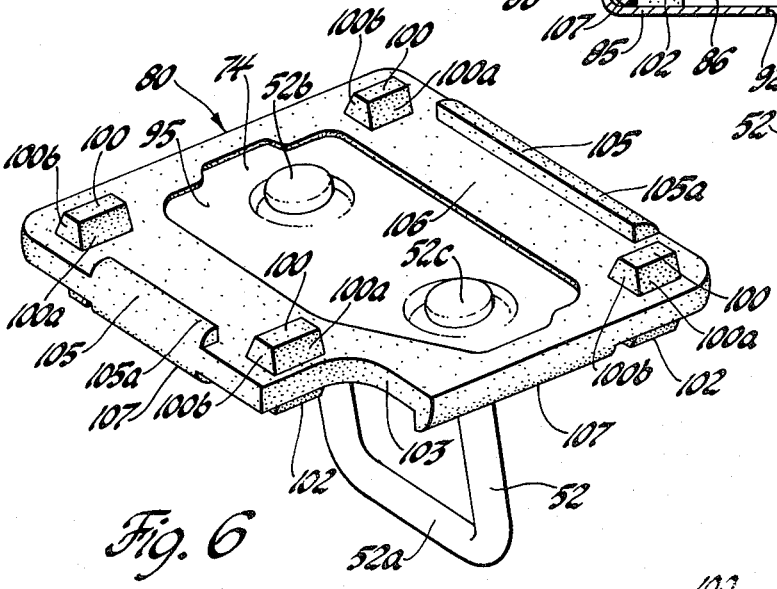
FIG. 6 is a top perspective view of part of the novel striker assembly of the present invention.
Figure 7:
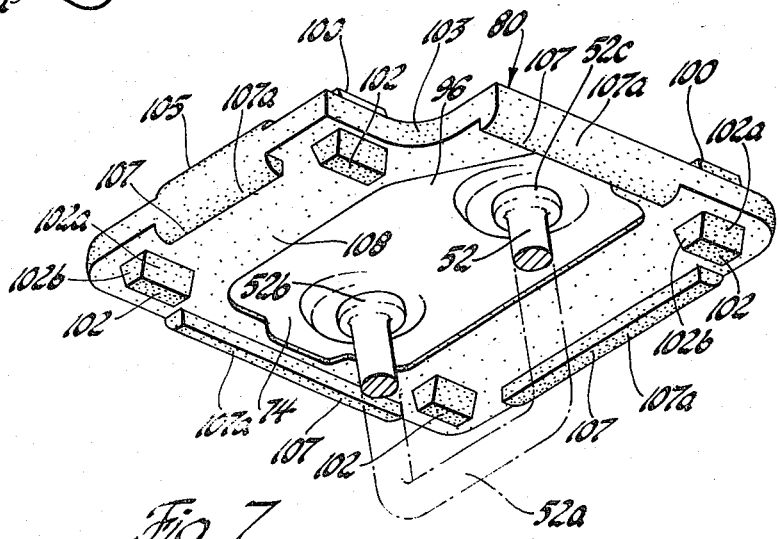
FIG. 7 is a bottom perspective view of part of the striker assembly of the present invention.

Surrounding the outer periphery of the support plate 74 is the elastomeric dampener means 80. The elastomeric dampener means 80 can be made from any suitable rubber or elastomeric material and is preferably molded around the support plate 74 to the configuration shown in FIGS. 6 and 7. The elastomeric means 80 is molded to the support plate 74 so as to completely surround the outer peripheral edges and adjacent portions of the top and bottom sides 95 and 96 thereof, as shown in FIGS. 6 and 7. The elastomeric means 80 include a plurality of first and second, integral, perpendicularly extending projections 100 and 102 extending in the opposite direction from each other and the plane of the support plate 74. The projections 100 and 102 are located adjacent the four corners of the support plate 74. The support plate 74 is cut away adjacent one corner, as indicated by reference numeral 103, and for a reason to be hereinafter described. The projections 100 and 102 are hereshown as being truncated and as having rectangularly shaped sides 100*a* and 102*a* and trapezoidally shaped ends 100*b* and 102*b*.

In addition to the projections 100 and 102 the elastomeric means 80 also includes a pair of elongated projections 105 which extend along opposite edges of its top surface 106. The projections 105 have curved upper surfaces 105*a* and are of a lesser height than the projections 100. Likewise the elastomeric means includes four elongated projections 107 extending along its four side edges thereof on its bottom side 108. The projections include lower surfaces which are curved, as shown by reference numeral 107*a*, and they have a height which is less than the height of the projections 102.

The striker assembly 50 is assembled by first staking the free ends 52*b* and 52*c* of the striker 52 to the support plate 74. Thereafter the elastomeric means 80 is molded via suitable molding apparatus around the peripheral edges and adjacent portions of the top and bottom sides 95 and 96 of the support plate 74 to the configuration shown in FIGS. 6 and 7. The striker 52 and elastomeric means 80 are then inserted as a unit into the recess 86 of the support housing 72 until the projections 102 engage the bottom surface 87 thereof and with the striker 52 extending through the opening 92. Thereafter, the cover plate 82, which is square shaped and slidably receivable within the recess 86, is placed over the elastomeric means 80 whereby it rests on the projections 100. The cover plate 82 is then retained in place by bending over the upper ends 112 of the walls 89, as shown in FIG. 4. The cover plate 82 is preferably stamped so as to be slightly recessed at its opposite ends, as indicated at reference numeral 114, so that when the ends 112 are bent thereover, the ends 112 will be flush with the remainder of the cover plate 82.

When the ends or tabs 112 are bent over to retain the cover plate 82 in place, the cover plate 82 causes the projections 102 and 100 to be compressed slightly so that the elastomeric means 80 is preloaded. The projections 105 and 107 serve to engage the walls 88 and 89 of the U-shaped portion 85 of the housing 72 to retain the striker assembly in place. They also serve as additional dampening means for the striker assembly 50 should the striker 52 be caused to be moved up and down relative to the housing 72 an extent such that these projections 105 and 107 engage either or both the bottom 87 of housing 72 and the cover plate 82 during certain operating conditions of the vehicle.

The entire striker assembly 50 is then bolted into place on the metal panel 40 of the hatchback 20 by suitable fasteners or bolts 120 which extend through aligned apertures 122 and 124 in the flanges 84 and the metal panel structure 40.

It should be noted that the striker assembly 50 also includes a locator pin means 130 which is suitably secured to the bottom 87 of the plate and retainer housing 72 adjacent one corner thereof. The notch 103 in the support plate 74 is provided so as to not interfere with the locator pin 130. The locator pin 130 is adapted to be received within an aperture 132 in a grommet 134 carried by a plate 136 of the latch mechanism 54. The locator pin 130 serves to guide the striker 52 into the tapered slot 60 on the retainer 59 of the latch mechanism 54.

From the above, it should be apparent that the elastomeric means 80 completely isolates the striker 52 from direct metal contact with its support housing 72 and cover plate 82. It should also be apparent that the projections 100 and 102 of the elastomeric means 80 serve as a spring dampening means to dampen vibrations transmitted to the striker 50 by the vehicle. The provision of the projections 100 and 102 and 105 and 107 of the elastomeric means 80 forms an important feature of the present invention, since it enables the dampening rate to be controlled and tuned to the hatchback means 20 being employed. It also significantly enhances the dampening effect over the use of a solid elastomeric means completely filling the recess 86 between the bottom 87 of the retainer plate and housing 72 and the cover plate 82. Thus by using an elastomeric dampening means with a plurality of projections the dampening rate can be tuned so that the vibrations will be out of phase with the resonant frequencies of the flexible hatchback employed so that noise will be reduced to acceptable levels.

Although the illustrated embodiments hereof have been described in great detail, it should be apparent that certain modifications, changes and adaptations may be made in the illustrated embodiments, and that it is intended to cover all such modifications, changes and adaptations which come within the spirit of the present invention.

The embodiments of the invention in which an explusive property or privilege is claimed are defined as follows:

1. In an automotive vehicle having vehicle body structure which defines a stowage compartment, a closure means supported by said body structure for movement between an open position to allow access to said compartment and a closed position in which it overlies said compartment to prevent access thereto, a striker assembly including a striker member carried by said closure means, and a releasable latch mechanism carried by said vehicle body structure and cooperably engageable with said striker member to latch said closure means in its closed position on said vehicle body structure, the improvement being that said striker assembly comprises a support and retainer member which is secured to said closure means, said housing member defining a recess facing the closure means and having an opening therethrough in communication with said recess and through which the striker member extends, a support plate secured to said striker member adjacent one end thereof and located within said recess, an elastomeric support means disposed in said recess and surrounding said support plate along and adjacent its peripheral edges, said elastomeric support means including a plurality of first and second, integral spaced projections respectively extending transversely of said support plate in opposite directions and with the first projections engaging said support and retainer member, and a cover plate secured to said support and retainer member for covering said recess and engaging said second projections to cause said first and second projections to be compressed a predetermined extent whereby said striker member is isolated from direct contact with said support and retainer member and said closure means and whereby noise resulting from vibrations due to flexing of said closure means is suppressed.

2. In an automotive vehicle having vehicle body structure which defines a stowage compartment, a closure means supported by said body structure for movement between an open position to allow access to said compartment and a closed position in which it overlies said compartment to prevent access thereto, a striker assembly including a striker member carried by said closure means, and a releasable latch mechanism carried by said vehicle body structure and cooperably engageable with said striker member to latch said closure means in its closed position on said vehicle body structure, the improvement being that said striker assembly comprises a metal support and retainer member which is secured to said closure means, said support and retainer member having a U-shaped portion, as viewed in cross-section, to define a recess facing the closure means and with said U-shaped portion having an opening therethrough in communication with said recess and through which the striker member extends, a metal support plate secured to said striker member adjacent one end thereof and located within said recess, an elastomeric support means disposed in said recess and surrounding said support plate along its peripheral edges, said elastomeric support means including a plurality of first and second, integral spaced projections respectively extending transversely of said support plate in opposite directions and with the first projections engaging said U-shaped portion of said support and retainer member, and a cover plate secured to said support and retainer member for covering said recess and engaging said second projections, said cover member causing said first and second projections to be compressed a predetermined extent whereby said striker member is isolated from direct metal contact with said support and retainer member and said closure means and whereby noise resulting from vibrations due to flexing of said closure means is suppressed.

3. In an automotive vehicle having vehicle body structure which defines a stowage compartment, a hatchback supported by said body structure for movement between an open position to allow access to said compartment and a closed position in which it overlies said compartment to prevent access thereto, said hatchback comprising an elongated contoured glass panel having one end hingedly connected to said body structure and its other end secured to a transversely extending metal panel, a striker assembly including a striker member carried by said metal panel, and a releasable latch mechanism carried by said vehicle body structure and cooperably engageable with said striker member to latch said hatchback in its closed position on said vehicle body structure, the improvement being that said striker assembly comprises a metal support and retainer member which is secured to said metal panel of said hatchback, said support and retainer member having a U-shaped portion, as viewed in cross-section, to define a recess facing the metal panel and with said U-shaped portion having an opening therethrough in communication with said recess and through which the striker member extends, a metal support plate secured to said striker member adjacent one end thereof and located within said recess, an elastomeric support means disposed in said recess and bonded to and surrounding said support plate along its peripheral edges, said elastomeric support means including a plurality of first and second integral, spaced projections respectively extending transversely of said support plate in opposite directions and with the first projections engaging said U-shaped portion of said support and retainer member, some of said first and second projections being located adjacent the corners of said support plate and other of said first and second projections being located along the support plate adjacent its side edges, and a cover plate secured to said support and retainer member for covering said recess and engaging said second projections, said cover member when secured to said support and retainer member causing said first and second projections to be compressed a predetermined extent whereby said striker member is isolated from direct metal contact with said support and retainer member and said hatchback whereby noise resulting from vibrations due to transverse flexing of said hatchback is suppressed.

* * * * *